US007525057B2

(12) United States Patent
Glasson

(10) Patent No.: US 7,525,057 B2
(45) Date of Patent: Apr. 28, 2009

(54) DEVICE LIMIT SWITCH WITH LOW PRE-TRAVEL AND HIGH OVERTRAVEL

(75) Inventor: Richard Glasson, Whippany, NJ (US)

(73) Assignee: Control Products Inc., East Hanover, NJ (US)

( * ) Notice: Subject to any disclaimer, the term of this patent is extended or adjusted under 35 U.S.C. 154(b) by 1 day.

(21) Appl. No.: 11/473,655

(22) Filed: Jun. 23, 2006

(65) Prior Publication Data

US 2007/0295587 A1 Dec. 27, 2007

(51) Int. Cl.
*H01H 3/00* (2006.01)
*H01H 13/00* (2006.01)

(52) U.S. Cl. ..... 200/329; 200/47

(58) Field of Classification Search ..... 200/329
See application file for complete search history.

(56) References Cited

U.S. PATENT DOCUMENTS 4,095,070 A 6/1978 Simpson
4,158,757 A * 6/1979 Reichert et al. ..... 200/302.1
4,965,420 A 10/1990 Phillips et al.
5,359,163 A 10/1994 Woodard
5,574,265 A * 11/1996 Falcon ..... 200/61.44
5,667,060 A * 9/1997 Luzzi ..... 200/302.1
6,861,604 B2 3/2005 McSwiggen
2006/0243576 A1 * 11/2006 Kuwana et al. ..... 200/329

OTHER PUBLICATIONS

Honeywell, Micro Switch Sensing and Control, Basic Switches Auxiliary Actuators Standard Basic, Created Dec. 20, 1996, Modified Mar. 5, 1996. Obtained from http://www.flamecorp.com/pdf_files/actuators_13.pdf.

Sacramento Electronic Supply, Sacramento Electronics : Product Detail, Micro Switch : Basic Pin Plunger, http://stores.sacelec.com/sacramentoelectronics/detail.jsp?name=BZ7RQT, Apr. 6, 2006.

* cited by examiner

*Primary Examiner*—Elvin G Enad
*Assistant Examiner*—Lheiren Mae A Anglo

(57) ABSTRACT

A low-profile robust switch having low pre-travel and high overtravel is provided through the use of telescoping actuator and a housing having holes of different sizes, the larger hole being sized to completely receive a fastener within the housing and the smaller one of the holes being sized to retain a portion of the fastener within the housing while the rest of the fastener extends from the housing.

10 Claims, 4 Drawing Sheets

DEVICE LIMIT SWITCH WITH LOW PRE-TRAVEL AND HIGH OVERTRAVEL

TECHNICAL FIELD

The present invention relates to a robust electrical switch having low pre-travel and high overtravel and, more particularly, to a device limit switch, i.e., a switch designed to respond to the presence or absence of an associated device or apparatus, having such attributes. In particular, this application is related to U.S. application Ser. No. 11/451,193, entitled "SWITCH WITH LOW PRE-TRAVEL AND HIGH OVERTRAVEL," filed on Jun. 12, 2006, now U.S. Pat. No. 7,399,938.

BACKGROUND OF THE INVENTION

Pre-travel and overtravel are two commonly specified requirements for a switch. Pre-travel is the amount of movement of the switch actuator mechanism before the switch changes its electrical state, i.e., the electrical state between the switch's terminals changes. The electrical state between a pair of switch terminals is typically either an electrical open circuit or a short circuit. Overtravel is the amount of movement that the switch actuator is designed to accommodate after the switch changes state. The sum of pre-travel and overtravel is the total travel of the switch actuator.

The rise of terrorism in the world has created the need to secure and protect activities of a general commercial nature. One such need is that of securing shipping containers against unauthorized opening after the container has been readied and sealed for shipment. Electronic systems that utilize electrical switches are being designed to track and monitor containers with respect to unauthorized opening as the containers are in transit to their respective destinations. In the co-pending application, Ser. No. 11/451,193, filed Jun. 12, 2006, and assigned to the present assignee, a switch is disclosed that is intended to be mounted on the door of the shipping container to detect unauthorized opening of the container. In this application, a device limit switch is needed to accompany an electrical "black box" that would be disposed in shipping container and would communicate the location of the container to a predetermined monitoring location. The device limit switch would be mounted in each shipping container along with the electronic "black box" and would quickly respond to any attempt to tamper with or move the black box. As there is a large embedded base of shipping containers, a device limit switch for this application must be compatible with existing container designs, must be robust enough to withstand the rough treatment typically experienced by shipping containers, and must operate flawlessly. As the device limit switch must also operate with different containers and black boxes having rather large part tolerances, the switch must provide low pre-travel and high overtravel in a low height switch. While electrical switches exist in a myriad of shapes, sizes, and designs, no existing switch exists that can meet the requirements of this described shipping container application. Accordingly, providing a device limit switch for a system designed to detect unauthorized tampering or movement of the contents of a shipping container would be desirable.

SUMMARY OF THE INVENTION

Broadly, the present invention relates to a low-profile switch having low pre-travel and high overtravel. Advantageously, this switch is suitable for use as a device limit switch in systems for tracking and monitoring shipping containers. The switch utilizes an actuator that, in response to an external force, engages with an actuation area of an internal switch element and causes the switch to change its electrical state. Preferably, the actuator is of a telescoping design that collapses upon itself so as to provide low pre-travel and high overtravel in a low height switch. In the disclosed embodiment, the switch also incorporates a housing having at least one pair of aligned, different sized mounting holes which receive a fastener. The larger hole is sized to complete receive the fastener. The smaller hole is sized to retain a portion of the fastener within the switch housing. As a result, it is more difficult to remove the fastener. Further, this hole arrangement precludes distortion of the switch housing from fastener overtightening and protects the fastener.

DETAILED DESCRIPTION OF THE INVENTION

A low profile, low pre-travel and high overtravel switch in accordance with the present invention is designed to preclude unauthorized tampering with a shipping container after it has been readied for shipment. In this application, the switch is mounted beneath an item and responds immediately to any removal of the item by triggering an alarm. The alarm could be audible, visible, or a combination of both and the alarm could sound either proximate to the container that had been tampered with or at a monitoring location far removed from the container.

Figure 1:
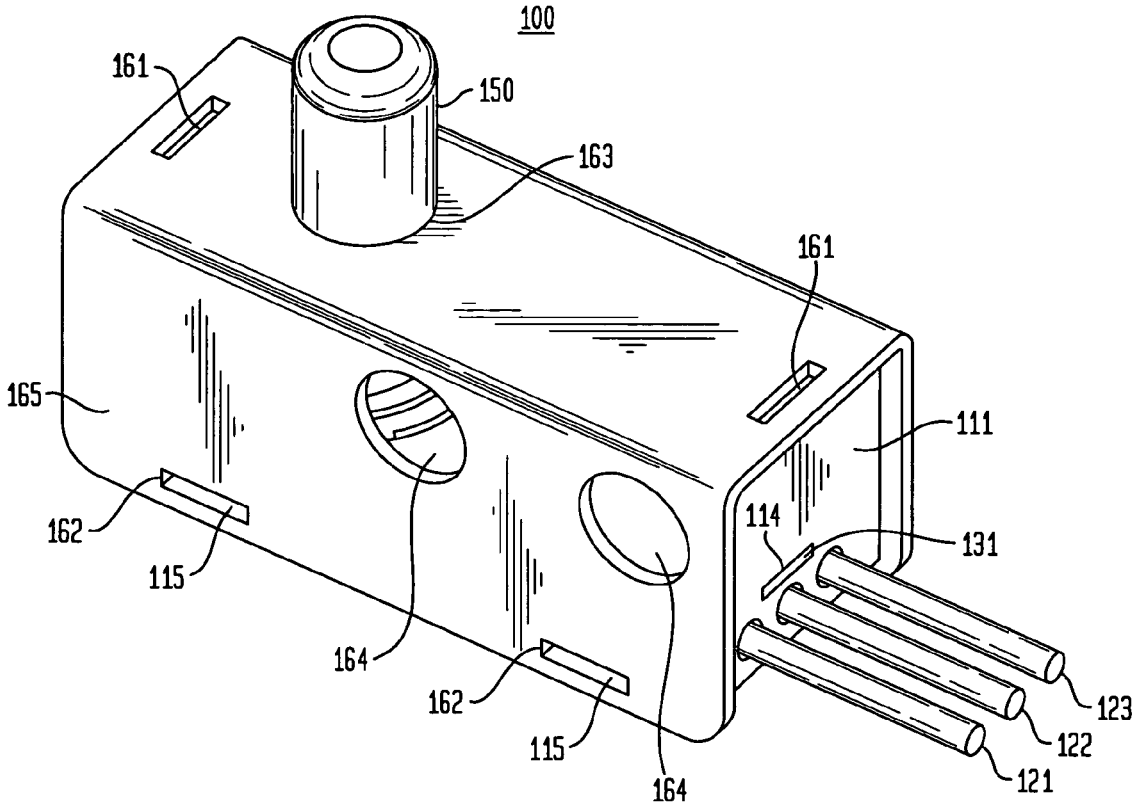
FIG. 1 is a perspective view of an assembled switch in accordance with an embodiment of the present invention.
Figure 2:
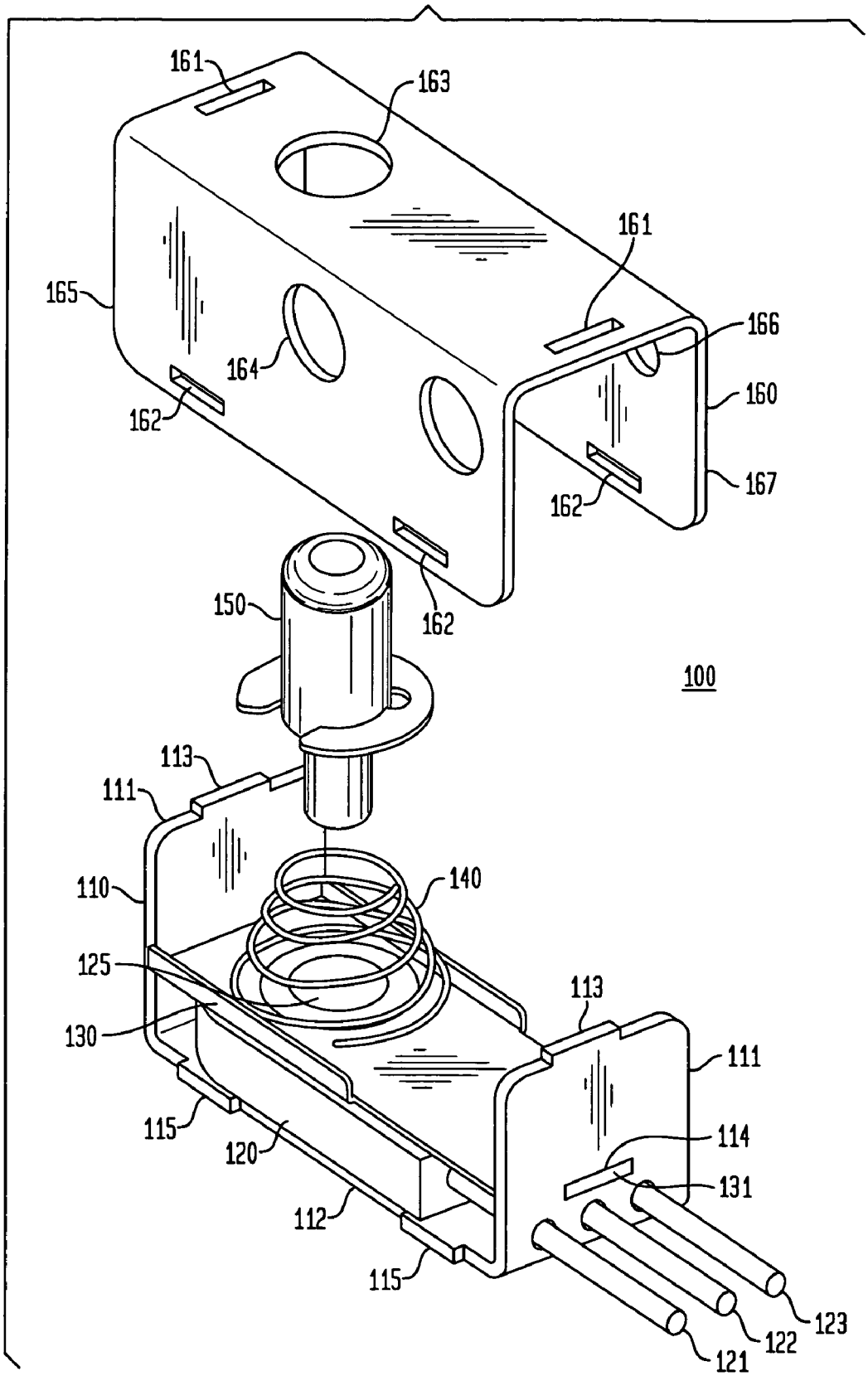
FIG. 2 is an exploded perspective view of the internal elements of the switch shown in FIG. 1.

Refer now to FIGS. 1 and 2. Switch 100, in accordance with the present invention, includes housing 110, switch element 120, switch element cover 130, conical spring 140, actuating assembly 150 and cover 160. In the contemplated shipping container application, the housing and cover of switch 100 are fabricated of stainless steel. However, in other less severe applications, other metals or plastics may be used.

Housing 110 includes end walls 111 and bottom 112. Preferably, the housing, switch element cover and cover are configured for snap together assembly. To provide such assembly, each of the end walls 111 includes an extending tab 113 that engages with a corresponding slot 161 in cover 160. Similarly, switch element cover 130 has a pair of extending tabs 131 (only one of which is shown in FIG. 2). Each of these tabs engages with a corresponding slot 114 in sidewall 111. Switch element cover 130 is designed to retain switch element 120 in its position as shown in FIG. 2. Finally, to complete the assembly, bottom 112 has four tabs 115, two of which are shown in FIG. 2. Each of these tabs engages with a different slot 162 in cover 160.

Cover 160 includes a hole 163 for receiving actuator assembly 150. Cover 160 also includes a pair of holes 164 in the sidewall 165 of cover 160. Each of the holes 164 is aligned with a corresponding smaller diameter hole 166 in sidewall 167 of cover 160 (only one such hole 166 is visible in FIG. 2). As will be described below, holes 164 and 166 are designed to enable fastening of switch 100 in a manner that conceals the fastener, and precludes distortion of housing 110 and cover 160 that could arise from fastener over-tightening. This hole arrangement also serves to protect the portion of the fastener that would otherwise be exposed if the holes 164 and 166 were of the same size.

Switch element cover 130 is designed to receive and retain a waterproof single-pole, double-throw (SPDT) commercially available switch element 120 on the bottom 112 of housing. Switch element 120 has three leads 121, 122 and 123 which are the conventional normally open, common and normally closed switch leads along with an actuating area 125. While for purposes of this description, switch element 120 is an SPDT element, the present invention may be used with a single pole single throw (SPST) having two leads—common and either normally open or normally closed. Suitable low profile switch elements for use in the present invention include the B7000 series waterproof switches offered by Control Products, Inc. of East Hanover, N.J. Within the B7000 series, those designated as B7113 and B7112 are SPDT and SPST implementations with momentary contacts.

When actuating area 125 of switch element 120 is not depressed, there is an electrical open circuit exists between the common lead and the normally open lead and an electrical short circuit between the common lead and the normally closed lead. When actuating area 125 is depressed to what is referred to as the actuation point, the electrical states between leads 121 and 122 and between 122 and 123 are flipped, i.e., they are an electrical short circuit and an electrical open circuit respectively. As will be described, in an assembled switch, the switch element is maintained close to its actuation point so that a very small movement of actuator 150 causes the switch element to toggle and change the electrical state between leads 121 and 122 and between 122 and 123.

Figure 3:
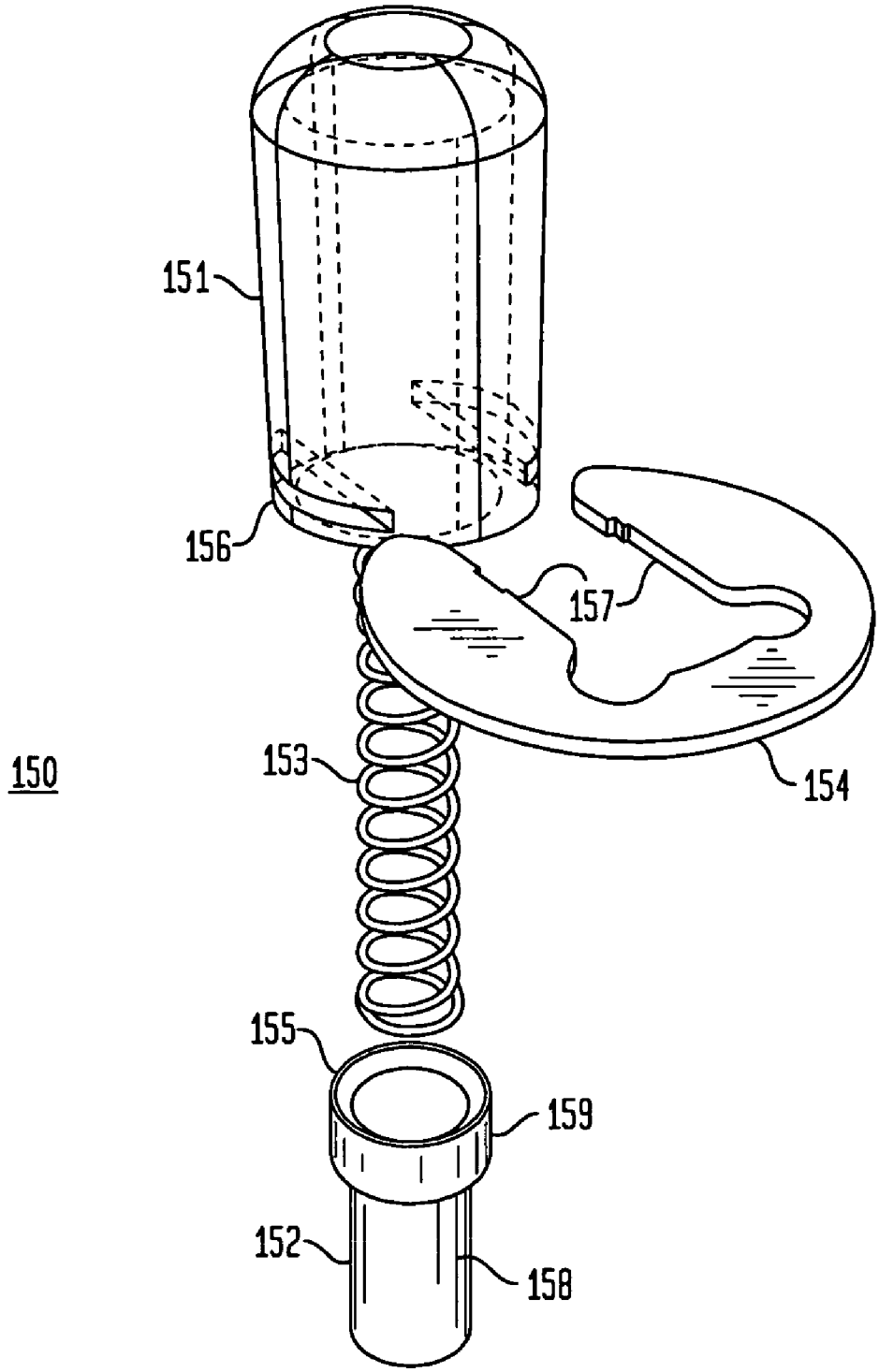
FIG. 3 is an exploded perspective view of the plunger assembly in the switch of FIGS. 1 and 2.

Refer now to FIG. 3 which shows further details about actuator 150. As shown, actuator is designed to be "telescoping". As shown, the actuator includes a hollow outer member 151, an inner member 152, an overtravel spring 153, and clip 154. When a slight amount of force is applied is applied to the end of outer member 151 it moves downwardly by a small amount sufficient to depresses actuation area 125 and change the electrical state between the switch element's terminals. As greater force is applied, overtravel spring 153 is compressed and the outer member telescopes over the inner member. Spring 153 has a higher spring constant than that of return spring 140 and the operation of spring 153 is designed to provide the high overtravel required in the contemplated shipping application. The telescoping action of the actuator assembly facilitates providing this overtravel while reducing the overall height of the switch that would otherwise be required if the actuator assembly was not telescoping.

In an assembled actuator 150, spring 153 is retained between seat 155 of inner member 152 and the walls defining the recess within outer member 151. Clip 154 maintains the actuator in its assembled state by engaging with slots 156 in outer member 151 so that portion 157 of the clip protrudes into the outer member and engages with the underside 158 of shoulder 159 on inner member 152. Referring to FIG. 2, clip 154 also serves as a stop for return spring 140 and engages with the walls of cover 160 surrounding hole 163 to retain all but a predetermined portion of outer member 151 within switch 100.

Figure 4:
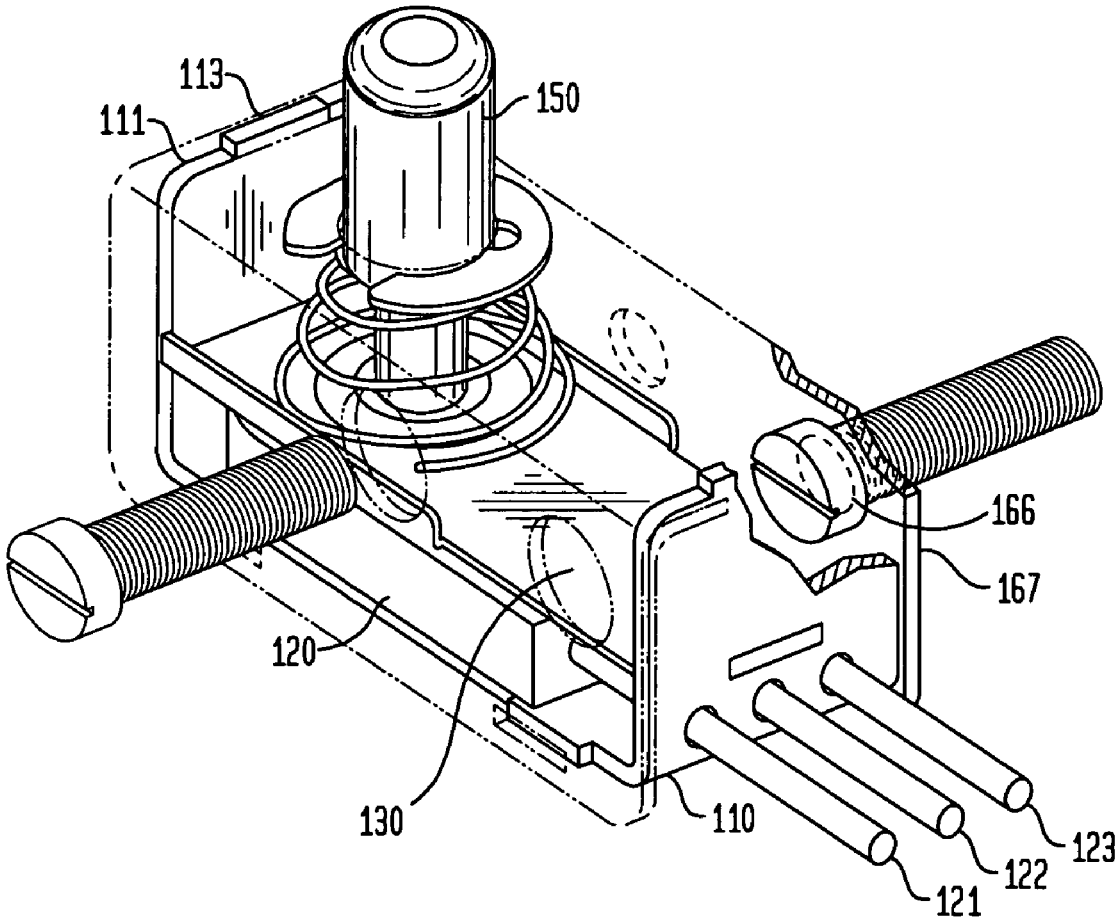
FIG. 4 is an exploded cutaway perspective view of the assembled switch in FIG. 1 showing its mounting arrangement.

Refer now to FIGS. 2 and 4. Switch 100 is designed to be mounted to a stationary structure using a pair of conventional fasteners. These fasteners are inserted completed through holes 164 in cover 160 and bottom out against the cover walls surrounding each of the holes 166. In this manner inadvertent over-torquing of these fasteners will not distort and possibly break the cover 160 or the housing 110. In addition, these holes serve to protect the head of the fastener, which would otherwise be exposed if hole 166 were of the same diameter as hole 164, and hamper unauthorized removal of the switch from its mounting site.

Switch 100 advantageously has a housing height of approximately 2.5 centimeters (cm) with a plunger free height above the housing of approximately 1.5 cm. The maximum pre-travel of switch 100 is 2 millimeters (mm) and the total travel of the plunger is 10 mm.

It should of course be understood that while the present invention has been described in reference to particular embodiments, other arrangements may be provided by those of ordinary skill in the art without departing from the spirit and scope of the present invention. For example, while the present invention utilizes a plunger element, other elements, including but not limited to a button, roller, cantilever can be substituted for the disclosed plunger. Or, for example, while the present invention relates to an electrical switch, the actuating mechanism disclosed could be uses to activate other types of switches, such as an optical switch. Finally, while in the described switch application, the disclosed switch functions as a device limit switch, the present invention is not restricted to only such application but, indeed, may be utilized in other types of switch applications as well.

What is claimed is:

1. A switch comprising:

a switch element having a plurality of terminals and an actuating area, said switch element providing different electrical states between said terminals in response to force being applied to said actuating area;

a switch actuator that engages with said actuating area in response to an externally applied force so as to cause the switch element to change the electrical state between said terminals; and a housing for receiving said switch element and said switch actuator, said housing having at least a pair of mounting holes substantially aligned to receive a fastener, one of said pair having a smaller diameter than the other of said pair, wherein the fastener passes completely the larger mounting hole and a portion of the fastener is retained within the housing by the housing surface surrounding the smaller mounting hole;

wherein the switch actuator includes an outer member, an inner member which is received by said outer member and a spring that is disposed within the outer and inner members; wherein the switch actuator further includes a clip which engages with the inner member via a slot in the outer member and thereby maintains the inner and outer members as an integral assembly.

2. The switch of claim 1 further including a second spring which is disposed to return the actuator to a predetermined condition after removal of the externally applied force.

3. The switch of claim 2 wherein the switch actuator is a plunger.

4. The switch of claim 2 wherein a spring constant of said first spring and a spring constant of said second spring are such that a greater force is required to compress said first spring than to compress said second spring.

5. The switch of claim 4 having a pre-travel less than 2 mm and an overtravel of up to 10 mm.

6. The switch of claim 1 wherein the housing includes multiple elements which interlock with one another to form said housing.

7. The switch of claim 6 wherein the multiple elements interlock to one another using tabs which engage with receiving slots.

8. A switch of claim 1 wherein the switch element is waterproof.

9. The switch of claim 1 wherein the housing is fabricated of stainless steel.

10. The switch of claim 1 wherein the switch is a limit switch.

* * * * *